US007359655B2

(12) United States Patent
Ito

(10) Patent No.: US 7,359,655 B2
(45) Date of Patent: Apr. 15, 2008

(54) STRUCTURE FOR COOLING THE INTERIOR OF AN IMAGE FORMING APPARATUS

(75) Inventor: Hiroshi Ito, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/501,112

(22) Filed: Aug. 9, 2006

(65) Prior Publication Data

US 2006/0269315 A1 Nov. 30, 2006

Related U.S. Application Data

(63) Continuation of application No. 10/849,793, filed on May 21, 2004, now Pat. No. 7,110,694.

(30) Foreign Application Priority Data

May 23, 2003 (JP) ..... 2003-146436

(51) Int. Cl.
*G03G 21/20* (2006.01)

(52) U.S. Cl. ..... 399/92

(58) Field of Classification Search ..... 399/92, 399/91, 93, 107, 124
See application file for complete search history.

(56) References Cited

U.S. PATENT DOCUMENTS

| | | | | |
|---|---|---|---|---|
| 5,166,727 | A | 11/1992 | Miyamoto et al. | 399/92 |
| 5,325,158 | A | 6/1994 | Guelfo et al. | 399/92 |
| 5,512,975 | A | 4/1996 | Kitsu et al. | 399/130 |
| 6,327,447 | B1 | 12/2001 | Nakano et al. | 399/92 |
| 6,415,118 | B1 | 7/2002 | Setoriyama et al. | 399/92 |
| 6,801,742 | B1 | 10/2004 | Mochimaru et al. | 399/309 |
| 2002/0031366 | A1 | 3/2002 | Tsubakimoto | 399/92 |
| 2002/0044801 | A1 | 4/2002 | Omata et al. | 399/309 |
| 2003/0147665 | A1 | 8/2003 | Ahn et al. | 399/92 |
| 2004/0234291 | A1 | 11/2004 | Iikawa et al. | 399/92 |
| 2005/0074255 | A1 | 4/2005 | Awaya | 399/92 |

FOREIGN PATENT DOCUMENTS

| | | | |
|---|---|---|---|
| JP | 61-277974 A | * | 12/1986 |
| JP | 04-086837 | | 3/1992 |
| JP | 08-277055 | | 10/1996 |
| JP | 09-114158 | | 5/1997 |
| JP | 11-174941 | | 7/1999 |
| JP | 2000-296934 | | 10/2000 |
| JP | 2002-072729 | | 3/2002 |
| JP | 2002-072832 | | 3/2002 |
| JP | 2002-311758 | | 10/2002 |
| JP | 2002-333814 | | 11/2002 |

* cited by examiner

*Primary Examiner*—Sophia S. Chen
(74) *Attorney, Agent, or Firm*—Smith, Gambrell & Russell, LLP

(57) ABSTRACT

An image-forming apparatus containing an image-forming member for forming a toner image and for transferring it onto a recording medium by an electrophotographic system, a fixing member for heat-fixing the toner image onto the recording medium, and a discharge conveying passage for conveying the recording medium onto which the toner image has been heat-fixed to a discharge portion, which are arranged in an apparatus body. The discharge conveying passage extends in the up-and-down direction along one side wall of the apparatus body. A cooling fan is arranged between the image-forming member and the discharge conveying passage on the inside facing the discharge conveying passage for forming an air stream heading from the side of the image-forming member toward the discharge conveying passage. Exhaust ports are formed in the discharge conveying passage facing the cooling fan and in the one side wall.

11 Claims, 5 Drawing Sheets

STRUCTURE FOR COOLING THE INTERIOR OF AN IMAGE FORMING APPARATUS

CROSS REFERENCE TO RELATED APPLICATION

The present application is a continuation of application Ser. No. 10/849,793, filed May 21, 2004, now U.S. Pat. No. 7,110,694 which is incorporated herein in its entirety by reference.

FIELD OF THE INVENTION

The present invention relates to an image-forming apparatus using an electrophotographic system, such as a copier, a printer, a facsimile or a composite unit thereof. More specifically, the invention relates to an image-forming apparatus equipped with a cooling means capable of cooling the interior of the body of the apparatus and the recording medium heated as it passes through a fixing unit.

DESCRIPTION OF THE RELATED ART

In the body of an image-forming apparatus using the electrophotographic system such as a copier, a printer, a facsimile or a composite unit thereof, there are arranged a fixing unit for heat-fixing a toner image transferred onto a recording medium such as a common paper, the recording medium that is conveyed after the toner image is heat-fixed thereto by the fixing unit, electric motors serving as sources of drive, electromagnetic clutches for connecting/disconnecting the driving force, a source of light for exposure and a control circuit, which are all serving as sources of heat that raise the temperature in the body of the apparatus. In a tandem color image-forming apparatus equipped with an image-forming means including process units in a number equal to the number of toner colors, in particular, LED heads are often used from the standpoint of decreasing the size. The temperature of the LED heads and the temperature of the electric motors for rotating the photosensitive material drums rise with the image-forming operation, and become a major cause of elevating the temperature in the body of the apparatus (the LED head, photosensitive material drum and electric motor are provided each in a number of one for every process unit). As the apparatus as a whole becomes small in size, the distances become narrow among the process units, and the temperature rises more conspicuously in the body of the apparatus. To stably maintain the gloss of the color image within a desired range, further, the toner image must be sufficiently melted more than that of the monochromatic image. Therefore, when a heating means such as a halogen heater is built-in in the upper and lower fixing rollers, the temperature further rises in the body of the apparatus and the temperature of the recording medium, too, is further elevated as it is conveyed after the toner image is heat-fixed thereto by the fixing unit. As the temperature in the body of the apparatus becomes excessively high, the toner stored in the developing apparatus and the toner recovered in the cleaning device may be solidified. As the temperature of the recording medium to which the toner image is heat-fixed becomes excessively high, further, the recording medium may stick to other recording media when it is discharged to the tray.

In view of the above technical background, it can be said that it is very important to cool the interior of the body of the image-forming apparatus and to cool the recording medium onto which the toner image is heat-fixed. As the conventional image-forming apparatus equipped with a cooling means of this type, there can be exemplified those disclosed in the following unexamined patent publications.

In an image-forming apparatus disclosed in Japanese Unexamined Patent Publication (Kokai) No. 2000-296934 (patent document 1), an upstream image-forming unit and a downstream image-forming unit are arranged in the body of the apparatus in a manner that the recording media (transfer members) are conveyed in the directions alternate to each other. The upstream image-forming unit and the downstream image-forming unit are coupled together through a coupling path. The recording medium is conveyed through a coupling path, so that images are formed on both surfaces of the recording medium. A cooling fan and a duct are provided in the body of the apparatus so that the air is sucked into the interior from the exterior on one side of the apparatus body through the coupling path, and that heat generated by the fixing unit is sucked and is discharged to the outer side from the rear side of the apparatus body. The image-forming apparatus is thus constituted in an attempt to forcibly cool the coupling path to prevent the temperature of the downstream image-forming unit from being raised by the recording medium of a high temperature conveyed from the upstream image-forming unit and to prevent the toner stored in the developing device from being solidified.

An image-forming apparatus disclosed in Japanese Unexamined Patent Publication (Kokai) No. 2002-072729 (patent document 2) is so constituted that the recording media (sheets) to which the toner image is heat-fixed are discharged onto a plurality of trays from a plurality of discharge ports formed in the apparatus body. This apparatus is equipped with a common cooling means for cooling the recording medium by blowing the air onto the recording medium discharged from the discharge port and onto the recording medium discharged onto the tray. The cooling means comprises a cooling fan and a plurality of ducts for guiding the air sucked by the cooling fan to the plurality of trays. The cooling means is further so designed as to also cool the interior of the apparatus. The image-forming apparatus is constituted as described above in an attempt to prevent the recording media discharged onto the trays from sticking without driving up the cost and without increasing the size of the apparatus.

An image-forming apparatus disclosed in Japanese Unexamined Patent Publication (Kokai) No. 2002-311758 (patent document 3) comprises an input means for receiving the kind of the recording medium (transfer member), a fixing means for heat-fixing the toner image onto the recording medium, a conveying means for conveying the recording medium onto which the toner image has been heat-fixed from the fixing means up to the discharge port, a cooling fan for blowing the air onto the recording medium which is conveyed by the conveying means, and a control means for operating the cooling fan when the kind of a particular recording medium is input through the input means. The cooling fan is arranged outside the conveying passage that is included in the conveying means. When the kind of the particular recording medium is input through the input means, the cooling fan is operated, and the air sucked from the exterior of the apparatus body is blown onto the recording medium that is conveyed, and the recording medium is cooled. The image-forming apparatus is thus constituted in an attempt to prevent the occurrence of scratches that results when the hardness is lowered in a state where a particular recording medium (e.g., recording medium for OHP) is heated at a high temperature as it passes through a conveying passage and, particularly, as it passes through a crooked conveying passage being quickly cooled after the toner image is heat-fixed, without producing large operation noise when the ordinary recording medium such as a common paper is used.

Japanese Unexamined Patent Publication (Kokai) No. 2002-333814 (patent document 4) discloses an image-forming apparatus in which a paper discharge portion is disposed immediately after the fixing means. The image-forming apparatus comprises a cooling fan provided near a suction port formed in the apparatus body and a ventilating duct for guiding the external air sucked by the cooling fan to the paper discharge portion. The exhaust port of the ventilating duct is opened immediately after the recording medium outlet of the fixing means. The image-forming apparatus is thus constituted in an attempt to sufficiently cool the recording medium of even a large size or a sheet for OHP to suppress the rise of temperature in the apparatus body by efficiently cooling the recording medium by blowing the air from the discharge port of the ventilating duct onto the recording medium immediately after being fixed (which is returned back into the apparatus body when the recording medium is to be printed on both surfaces thereof).

However, the image-forming apparatus disclosed in the above patent documents 1 to 4 have problems as described below.

Namely, with the image-forming apparatus disclosed in the patent document 1, the coupling path and the recording medium passing through the coupling path are cooled by the cooling fan. However, this apparatus has not been so constituted as to cool both the upstream image-forming unit and the downstream image-forming unit arranged in the apparatus body. In particular, the downstream image-forming unit cannot be substantially cooled by the cooling fan. As the cooling means for cooling the coupling path and the fixing unit, further, it is necessary to use a duct having a large space in addition to the cooling fan. Therefore, the apparatus as a whole becomes bulky resulting in an increase in the weight and in an increase in the cost.

The image-forming apparatus taught in the patent document 2 is capable of cooling the recording medium discharged from the discharge port and the recording medium discharged onto the tray. There has further been disclosed a constitution capable of exhausting the air in the apparatus body by using an exhaust fan and of blowing the air onto a plurality of trays. However, the exhaust fan has been disposed on the outer side of the paper discharge passage, and it is highly probable that when the recording media passes consecutively through the paper discharge passage, the exhaust of the air is substantially interrupted in the apparatus body, and the heat-fixed recording medium is not cooled and the exhaust of the air is not effected as desired in the apparatus body. As a result, it is likely that the temperature of the recording media and the temperature in the apparatus body excessively rise temporarily. In addition to providing the cooling fan, further, it is necessary to provide a plurality of ducts for guiding the air sucked by the cooling fan to the plurality of trays. Therefore, the apparatus as a whole becomes complex in constitution, large in size, heavy in weight and expensive to produce.

In the image-forming apparatus disclosed in the patent document 3, the cooling fan is disposed on the outer side of the conveying passage and, hence, the air sucked from the outer side of the apparatus body is blown onto the recording medium that is passing through the conveying passage to cool the recording medium. It is not, however, considered that the heat in the apparatus body is discharged by the cooling fan. The reason is because the patent document 3 does not teach that the air introduced into the apparatus body by the cooling fan is exhausted, and the apparatus is intended to cool the recording medium by operating cooling fan for only those particular recording media as OHP sheets. Therefore, the cooling fan is not operated in forming images on common papers. Besides, if the image-forming apparatus uses the cooling fan for cooling the image-forming portion, then, the external air fed by the cooling fan is forced to pass near the fixing unit. As a result, the air introduced by the cooling fan into the apparatus body is heated by the fixing unit, and the heated air is further heated inside the apparatus resulting in an excess rise of the temperature in the apparatus body.

The image-forming apparatus disclosed in the patent document 4 is capable of cooling the recording medium immediately after the heat-fixing. The patent document 4, however, does not disclose the constitution for discharging the heat in the apparatus body. Besides, a dedicated ventilating duct is necessary for guiding the external air sucked by the cooling fan to the paper discharge portion causing the constitution to become complex, weight to increase and cost to increase.

As will be obvious from the foregoing description, the cooling means provided in the image-forming apparatuses disclosed in the above patent documents 1 to 4 are chiefly for cooling the recording media that are heat-fixed, but are not for exhausting the heat in the apparatus bodies and, particularly, are not for cooling the image-forming means arranged in the apparatus bodies.

SUMMARY OF THE INVENTION

It is an object of the present invention to provide a novel image-forming apparatus capable of efficiently and effectively cooling the interior of the body of the image-forming apparatus and particularly, the periphery of the image-forming means and the recording medium heat-fixed by the fixing unit with a simple and inexpensive constitution.

According to the present invention, there is provided an image-forming apparatus comprising an image-forming means for forming a toner image and for transferring it onto a recording medium by an electrophotographic system, a fixing means for heat-fixing the toner image onto the recording medium, and a discharge conveying passage for conveying the recording medium onto which the toner image has been heat-fixed to a discharge portion, which are arranged in an apparatus body, the discharge conveying passage extending in the up-and-down direction along one side wall of the apparatus body, wherein at least one cooling fan for forming an air stream heading from the side of the image-forming means toward the discharge conveying passage is arranged between the image-forming means and the discharge conveying passage on the inside facing the discharge conveying passage, and exhaust ports are formed in the discharge conveying passage facing the cooling fan and in the one side wall.

It is desired that the cooling fan is disposed at a distance relative to the image-forming means in a horizontal direction, and when the cooling fan is operated, the air sucked into the interior of the apparatus body from the exterior thereof is blown onto the discharge conveying passage passing through the periphery of the image-forming means.

It is desired that the image-forming means comprises a plurality of process units arranged in parallel nearly in the axial direction of the cooling fan, and when the cooling fan is operated, the air sucked into the interior of the apparatus body from the exterior thereof is blown onto the discharge conveying passage passing through the vicinities of the process units.

It is desired that the fixing means is so arranged as to extend in a horizontal direction at right angles with the axial direction of the cooling fan under the cooling fan, a partitioning wall is arranged between the fixing means and the cooling fan and between the fixing means and the image-forming means, and extends in a horizontal direction at right angles with the axial direction to substantially partition the fixing means, the cooling fan and the image-forming means from each other, and the air heading from the side of the image-forming means toward the discharge conveying passage passes through above the partitioning wall.

It is desired that a gap is formed in a tilted manner between the partitioning wall and the image-forming means so that the air flows upward from the lower side of the image-forming means toward the cooling fan.

It is desired that the apparatus body has two other side walls facing each other at a distance in a horizontal direction at right angles with the axial direction of the cooling fan, and ventilating ports are formed in one and/or both of the two other side walls, the ventilating ports being arranged in a region spanning from a lower side to an upper side of the partitioning wall on an extension of the partitioning wall in one and/or both of the two other side walls.

It is desired that the cooling fan for forming an air stream that flows to the exterior from the interior of the apparatus body passing through the ventilating ports to cool the fixing means is arranged on an extension of the inner region of the partitioning wall on the inside of the ventilating ports formed in one of the two other side walls.

It is desired that the other ventilating ports are formed in an upper end of one of the two other side walls and at a position near the other side wall facing the one side wall, and a cooling fan is arranged on the inside of the other ventilating ports to suck the air into the interior of the apparatus body from the exterior thereof through the other ventilating ports.

It is desired that the apparatus body comprises four side walls which are a front side wall located on the front side of the apparatus body, a rear side wall located on the rear side facing the front side wall at a distance, a right side wall located on the right side of the apparatus body, a left side wall located on the left side and facing the right side wall at a distance, and an upper cover covering the four side walls from the upper side, the one side wall being the rear side wall.

It is desired that the upper cover has the paper discharge portion which is tilted downward toward just the upper side of the cooling fan from the front side to the rear side of the apparatus body, the top portion of the image-forming means is arranged facing the lower surface of the paper discharge portion, just thereunder at a gap and, when the cooling fan is operated, the air that ascends being heated in the apparatus body passes through the gap between the top portion of the image-forming means and the lower surface of the paper discharge portion and flows toward the cooling fan along the lower surface of the paper discharge portion.

DETAILED DESCRIPTION OF THE PREFERRED EMBODIMENTS

Figure 1:
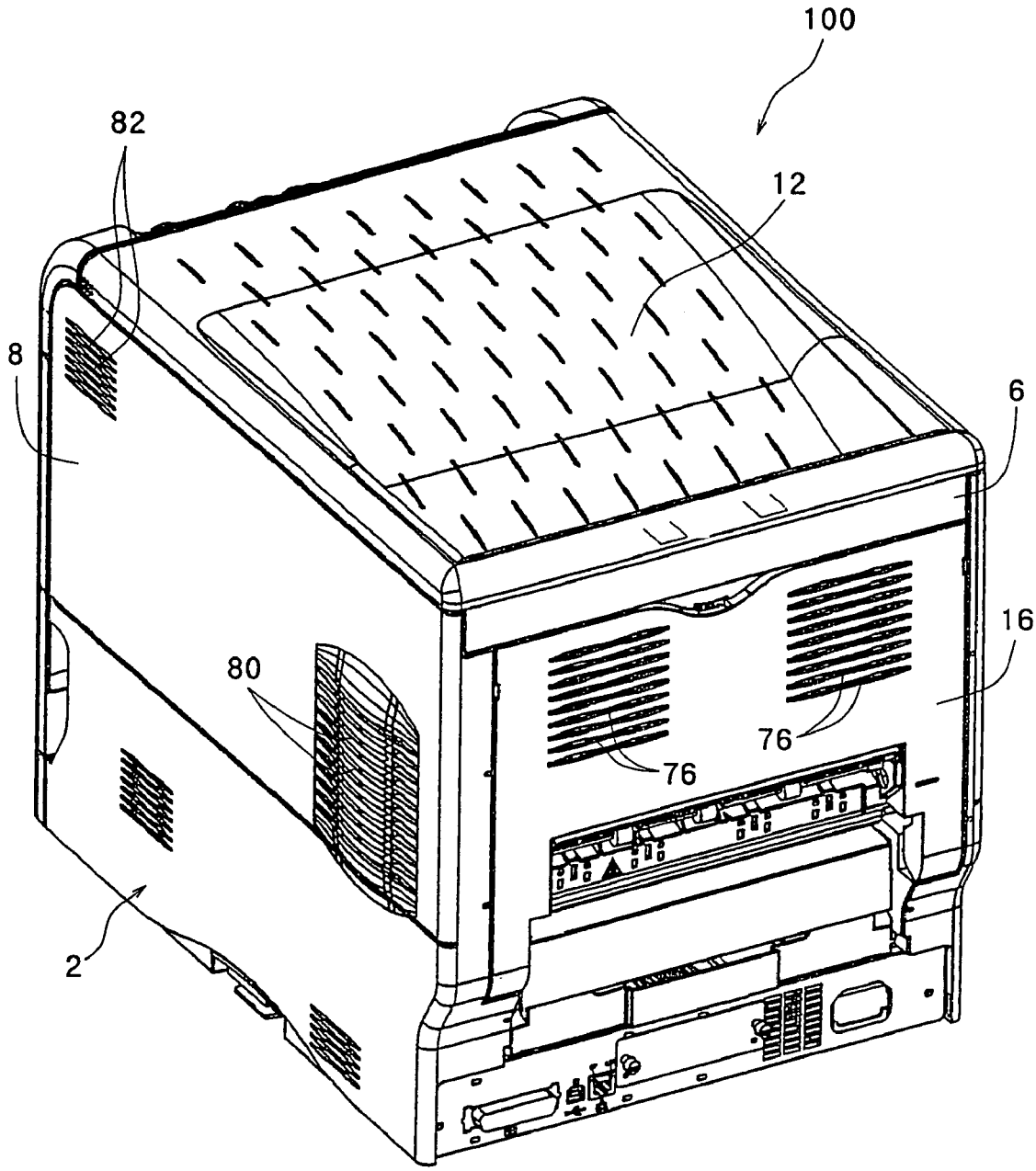
FIG. 1 is a perspective view of a tandem color image-forming apparatus which is an embodiment of an image-forming apparatus constituted according to the present invention.

A tandem color image-forming apparatus which is an embodiment of the image-forming apparatus constituted according to the present invention will now be described in detail with reference to the accompanying drawings.

Referring to FIGS. 1 to 5, a tandem color image-forming apparatus (or, more specifically, a tandem color printer) generally designated at 100 has an apparatus body 2 of nearly a rectangular parallelopiped shape. The apparatus body 2 comprises four side walls, i.e., a front side wall 4 positioned on the front side (right side in FIGS. 4 and 5) of the apparatus body 2, a rear side wall 6 that is positioned on the rear side (left side in FIGS. 4 and 5) and faces the front side wall 4 at a distance, a right side wall positioned on the right side (upper side in FIG. 5) of the apparatus body 2, and a left side wall 10 that is positioned on the left side (lower side in FIG. 5) of the apparatus body 2 and faces the right side wall 8 at a distance. At a top end of the front side wall 4 located on the front side of the apparatus body 2 to which the user faces, there is arranged a tilted portion 4*a* that is tilted upward toward the rear side of the apparatus body 2, and various kinds of operation buttons are arranged on the tilted portion 4*a*. The upper surface of the apparatus body 2 is covered with a discharged paper tray 12 formed integrally with the upper cover. The discharged paper tray 12 constituting a discharge portion of the recording media is tilted downward from the front side toward the rear side of the apparatus body 2. An opening 14 of nearly a rectangular shape is formed in the rear side wall 6, and a rear cover 16 of nearly a rectangular shape is mounted to open and close the opening 14. It can be said that the rear cover 16 constitutes portion of the rear side wall 6 in a state where the opening 14 is closed (i.e., the state shown in FIG. 1).

Figure 4:
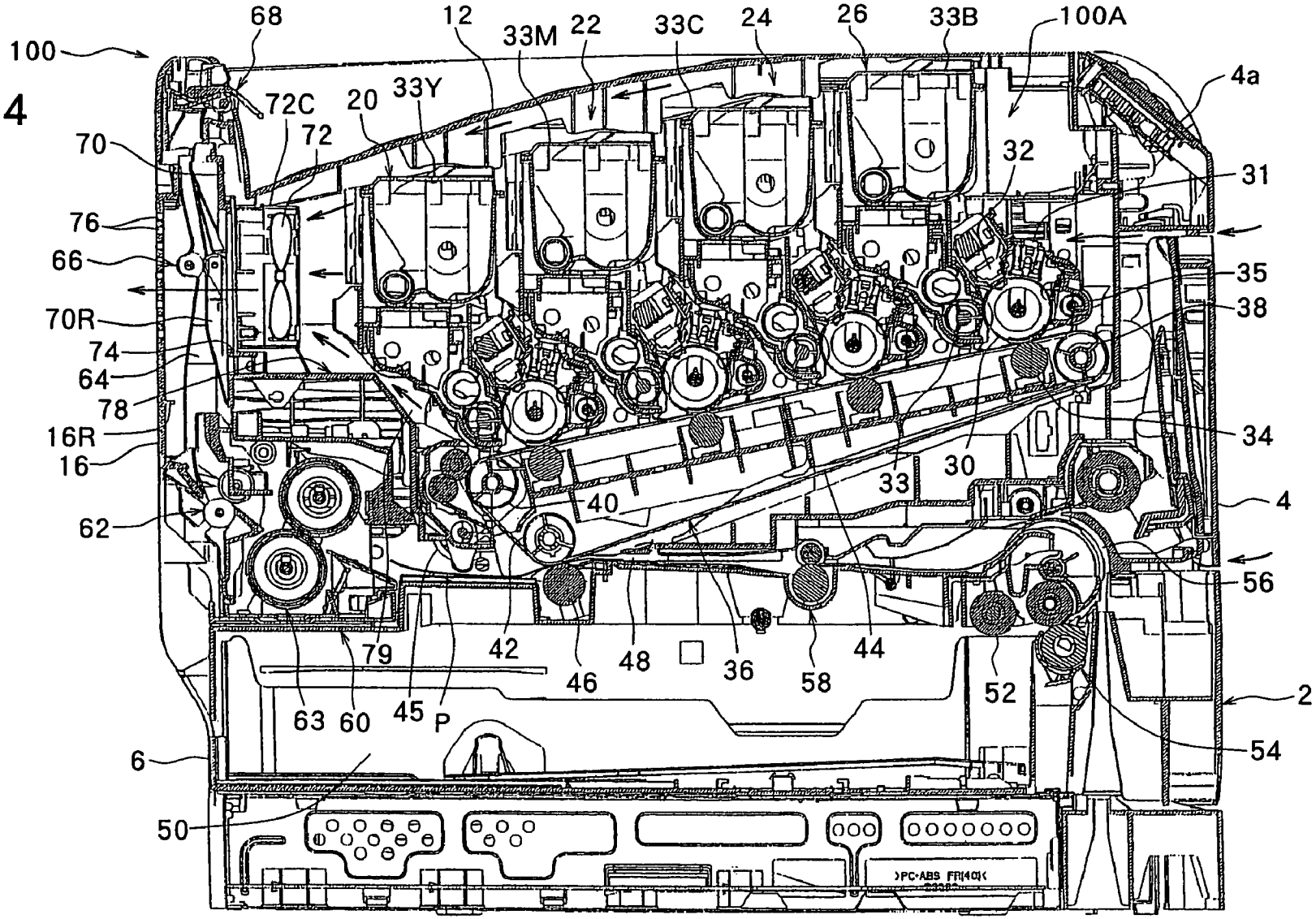
FIG. 4 is a sectional view of the image-forming apparatus of FIG. 1.
Figure 5:
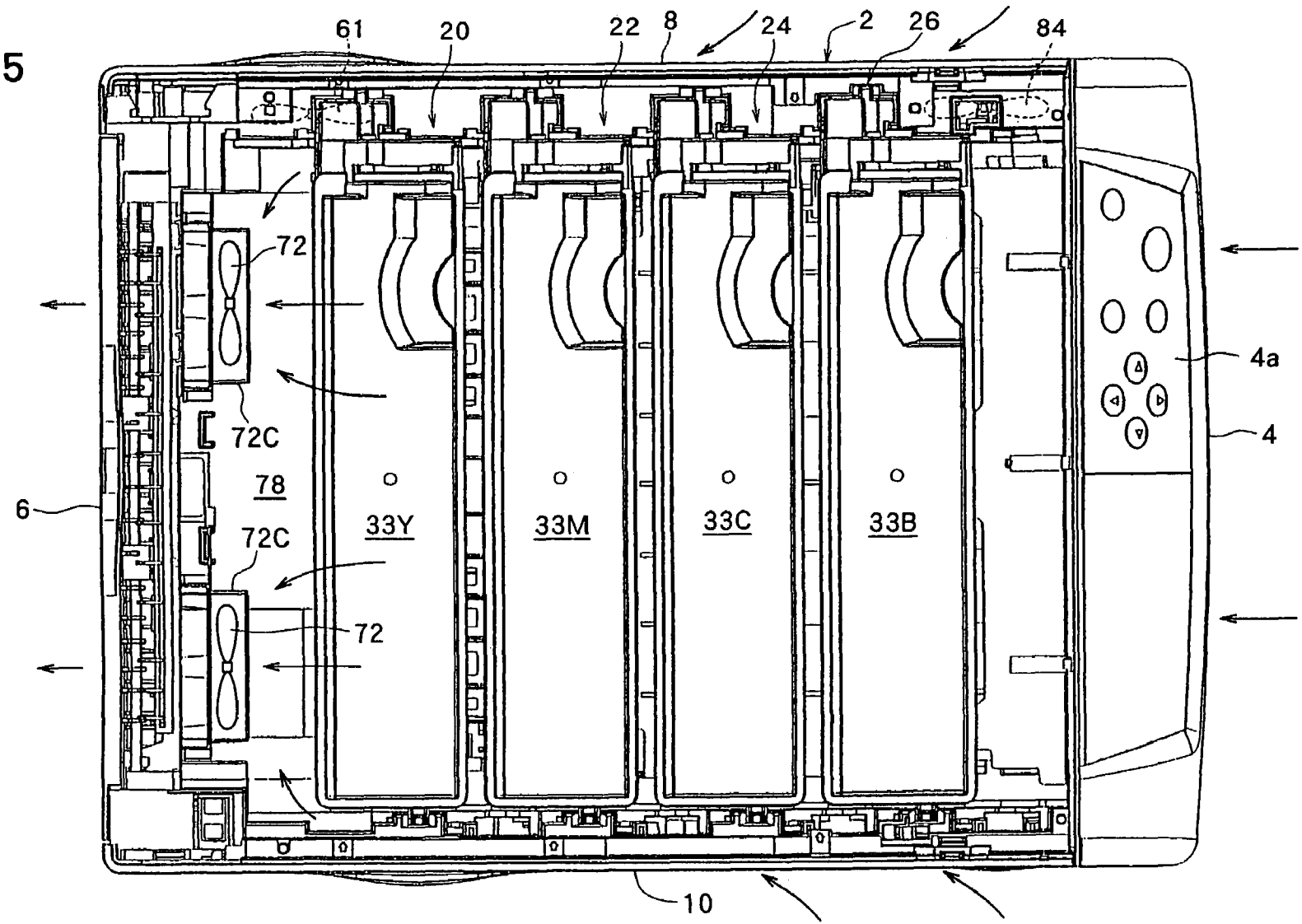
FIG. 5 is a plan view of the image-forming apparatus of FIG. 1 in a state where an upper cover is removed.

Referring to FIGS. 4 and 5, in the apparatus body 2, there are arranged a process unit 20 for yellow, a process unit 22 for magenta, a process unit 24 for cyan and a process unit 26 for black in this order from the left toward the right in FIG. 4. Each of these process units 20, 22, 24 and 26 has image-forming elements such as a photosensitive material drum 30, a charger unit 31, an LED head 32, a developing unit 33, a primary transfer roller 34 and a cleaning unit 35. In FIG. 4, among the image-forming elements, the process unit 26 for black only has reference numerals attached to the image-forming elements for simplifying the drawing. These process units 20, 22, 24 and 26 are nearly linearly arranged in parallel in the above-mentioned order in nearly the horizontal direction or, in this embodiment, from the left diagonally toward the upper right in FIG. 4.

The developing units 33 of the process units 20, 22, 24 and 26 are provided with toner feeding containers 33Y, 33M, 33C and 33B for feeding toners of corresponding colors. An intermediate transfer belt mechanism 36 is arranged on the underside of the process units 20, 22, 24 and 26. The intermediate transfer belt mechanism 36 comprises a drive roller 38, driven rollers 40 and 42, and an intermediate transfer belt 44 wrapped round these rollers. The driven roller 40 is arranged on the left side in the apparatus body 2 in FIG. 4, and the drive roller 38 is arranged on the right side in FIG. 4 at a distance relative to the driven roller 40. The drive roller 38 is located at a position slightly higher than the driven roller 40. The driven roller 42 is positioned diagonally to the lower right of the driven roller 40 in FIG. 4. A cleaning unit 45 for cleaning the intermediate transfer belt 44 is arranged adjacently at the left end of the intermediate transfer belt mechanism 36 in FIG. 4.

A traveling region at the upper end of the intermediate transfer belt 44 extending straight between the drive roller 38 and the driven roller 40 is so positioned as to be slightly tilted upward from the left toward the right relative to a horizontal line in FIG. 4. In each of the process units 20, 22, 24 and 26, the primary transfer roller 34 is press-contacted to the photosensitive material drum 30 from the lower side via the upper end traveling region of the intermediate transfer belt 44. A secondary transfer roller 46 is arranged under the driven roller 42, and is press-contacted to the driven roller 42 from the lower side via the intermediate transfer belt 44. In FIG. 4, the drive roller 38 is rotated clockwise. Therefore, the intermediate transfer belt 44 and driven rollers 42 and 44 are rotated clockwise, too. Although the primary transfer rollers 34 are arranged on the side of the intermediate transfer belt mechanism 36 and are not provided integrally with the process units 20, 22, 24 and 26 from the standpoint of the apparatus, the primary transfer rollers 34 are here included in the process units 20, 22, 24 and 26 from the standpoint of the transfer function. The process units 20, 22, 24 and 26, intermediate transfer belt mechanism 36, secondary transfer roller 46 and cleaning unit 45 constitute an image-forming means 100A in the image-forming apparatus 100.

The top portion of the image-forming means 100A or, in this embodiment, the top portions of the toner feeding contains 33Y, 33M, 33C and 33B of the process units 20, 22, 24 and 26, are arranged just under the lower surface of the discharged paper tray 12 which is the paper discharge portion tilted downward from the front side toward the rear side of the apparatus body 2 at a gap.

Under the intermediate transfer belt mechanism 36, a conveying passage 48 for conveying a recording medium or generally a common paper P extends in nearly a horizontal direction in FIG. 4. A nipping portion between the secondary transfer roller 46 and the driven roller 42 is disposed on the way of the conveying passage 48. A paper feed cassette 50 is disposed under the conveying passage 48. A pick-up roller 52 is disposed just above the paper feed cassette 50 at the right end in FIG. 4, and a pair of separation rollers 54 are arranged downstream side of the pick-up roller 52. The downstream side of the pair of separation rollers 54 is connected to the conveying passage 48 via a reversing passage 56. A pair of resist rollers 58 are arranged in the conveying passage 48 upstream of the secondary transfer roller 46. A fixing means 60 and a pair of conveyer rollers 62 are arranged in the conveying passage 48 toward the downstream in this order on the downstream of the secondary transfer roller 46. The fixing means 60 has a pair of fixing rollers 63. The pair of fixing rollers 63 are so arranged as to extend between the right side wall 8 and the left wide wall 10 (so as to extend in a direction perpendicular to the surface of the paper in FIG. 4).

A discharge conveying passage 64 is arranged downstream of the pair of conveyer rollers 62 to convey the recording medium onto which the toner image is heat-fixed by the fixing means 60 to the discharged paper tray 12. The discharge conveying passage 64 is arranged on the inside of the rear cover 16 so as to extend in the up-and-down direction along the rear cover 16 that constitutes part of the rear side wall 6 which is a side wall of the apparatus body 2. A pair of conveyer rollers 66 are arranged on the way of the discharge conveying passage 64, and a pair of discharge rollers 68 are arranged at the outlet of the discharge conveying passage 64. The discharge conveying passage 64 is formed by a plurality of ribs 16R arranged on the inside of the rear cover 16 and a plurality of ribs 70R arranged on the inner side wall 70 which is arranged on the inner side of the rear side wall 6 facing thereto at a distance in the apparatus body 2. The plurality of ribs 70R arranged on the inner side wall 70 is so arranged as to be faced to the ribs 16R of the rear cover 16 at a gap (in a state where the rear cover 16 is closed). The ribs 16R of the rear cover 16 and the ribs 70R of the inner side wall 70 are so arranged as to extend in the up-and-down direction at a distance in a direction perpendicular to the surface of the paper in FIG. 4.

At least one cooling fan or, in this embodiment, two cooling fans 72 are arranged on the inside facing the discharge conveying passage 64 in the image-forming means 100A or, in this embodiment, in space between the process unit 20 and the discharge conveying passage 64 in the image-forming means 100A to form an air stream heading from the side of the image-forming means 100A toward the discharge conveying passage 64 (see arrows in FIG. 4). If described more concretely, two cylindrical casings 72C are arranged on the inner side wall 70 extending inward from the inner side wall 70 at a distance in a direction perpendicular to the surface of the paper in FIG. 4. The cooling fan 72 is disposed in each casing 72C so as to rotate. The axes of the casings 72C and of the cooling fans 72 extend horizontally and in parallel with each other in the right-and-left direction (in the back-and-forth direction of the apparatus body 2) in FIGS. 4 and 5.

A plurality of exhaust ports 74 are formed in the discharge conveying passage 64 facing the cooling fans 72. The exhaust ports 74 are formed in the inner side wall 70 at positions corresponding to the casings 72C (at positions corresponding to the cooling fans 72) so as to be opened among the ribs 70R formed on the inner side wall 70. A plurality of exhaust ports 76 are formed in the rear cover 16 at positions corresponding to the casings 72C (at positions corresponding to the cooling fans 72) so as to extend in a direction at right angles with the ribs 16R at a distance in the up-and-down direction. The exhaust ports 76 are opened between the ribs 16R formed in the rear cover 16.

The fixing means 60 is arranged under the cooling fans 72 so as to extend in a horizontal direction at right angles with the axial directions of the cooling fans 72. A partitioning wall 78 is arranged between the cooling fans 72 and the fixing means 60 in order to substantially partition the fixing means 60 from the air stream produced by the cooling fans 72. The partitioning wall 78 is so arranged as to extend in a horizontal direction at right angles with the axial directions of the cooling fans 72. The partitioning wall 78 has a horizontal top portion having a predetermined width in the right-and-left direction in FIG. 4, the left end of the horizontal top portion in FIG. 4 being connected to the inner side wall 70, and the right end thereof being connected to an upper end of a side portion that extends between the process unit 20 and the fixing means 60 downward in a tilted manner toward the conveying passage 48 and hanging down to the conveying passage 48. A tilted gap 79 is formed between the partitioning wall 78 and the image-forming means 101A or, in this embodiment, the process unit 20 so that the air flows upward from the lower side of the process unit 20 toward the cooling fan 72.

The apparatus body 2 has the right side wall 8 and the left side wall 10 which are the other side walls facing each other at a distance in a horizontal direction at right angles with the axial directions of the cooling fans 72. A plurality of ventilating ports 80 are formed in one or both of the right side wall 8 and the left side wall 10 or in both of them in this embodiment (see FIGS. 1 to 3). The ventilating ports 80 formed in both the right side wall 8 and the left side wall 10 are arranged in the regions spanning from the lower side to the upper side of the partitioning wall 78 on an extension of the partitioning wall 78 in both the right side wall 8 and the left side wall 10. A cooling fan 61 (shown by a dotted line in FIG. 5) is arranged inside the ventilating ports 80 formed in the right side wall 8 on an extension of the lower region of the partitioning wall 78 to form an air stream that flows toward the outer side from the interior of the apparatus body 2 through the ventilating ports 80 to cool the fixing means 60.

Figure 2:
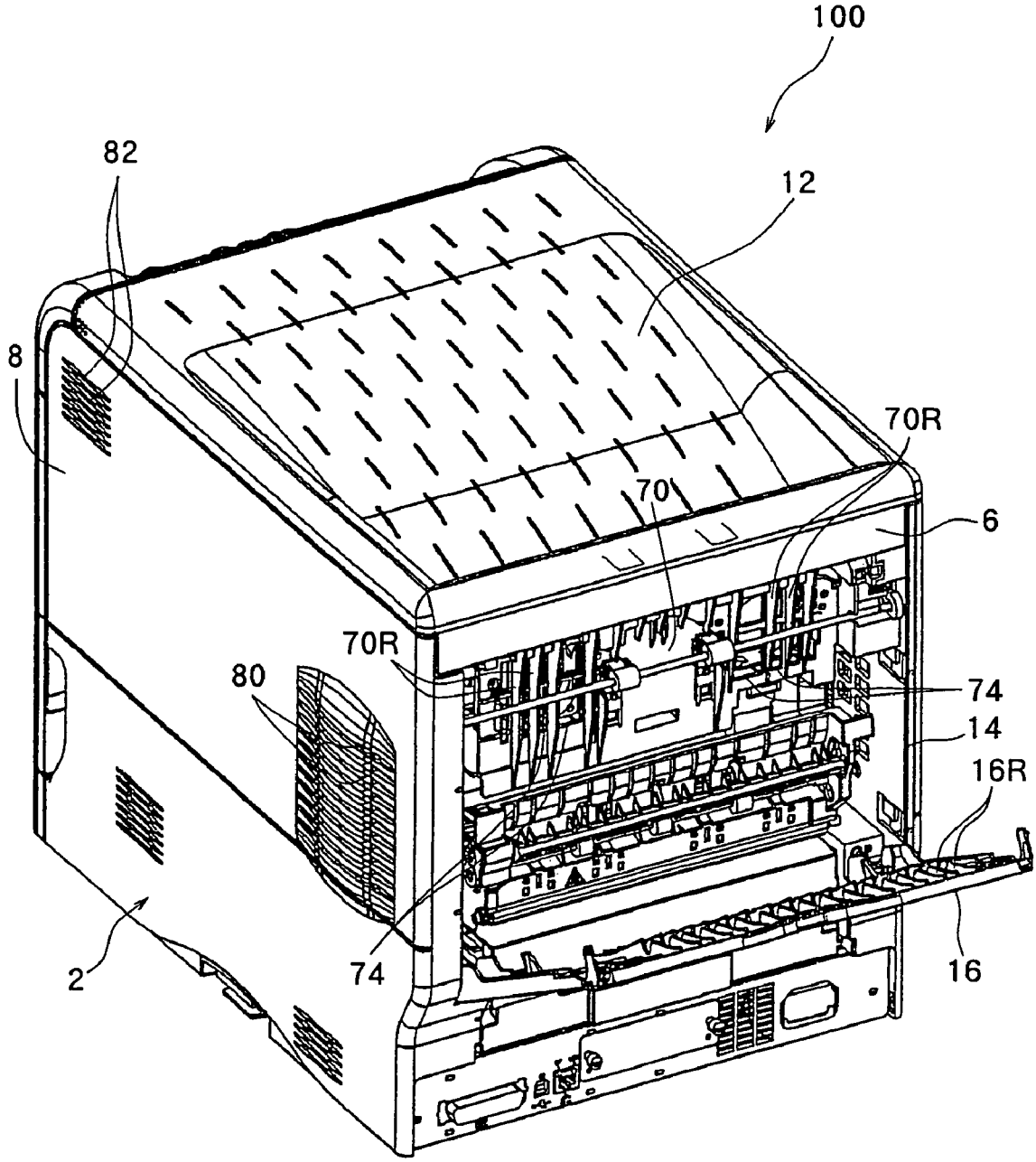
FIG. 2 is a perspective view illustrating the image-forming apparatus of FIG. 1 in a state where a rear cover is opened.
Figure 3:
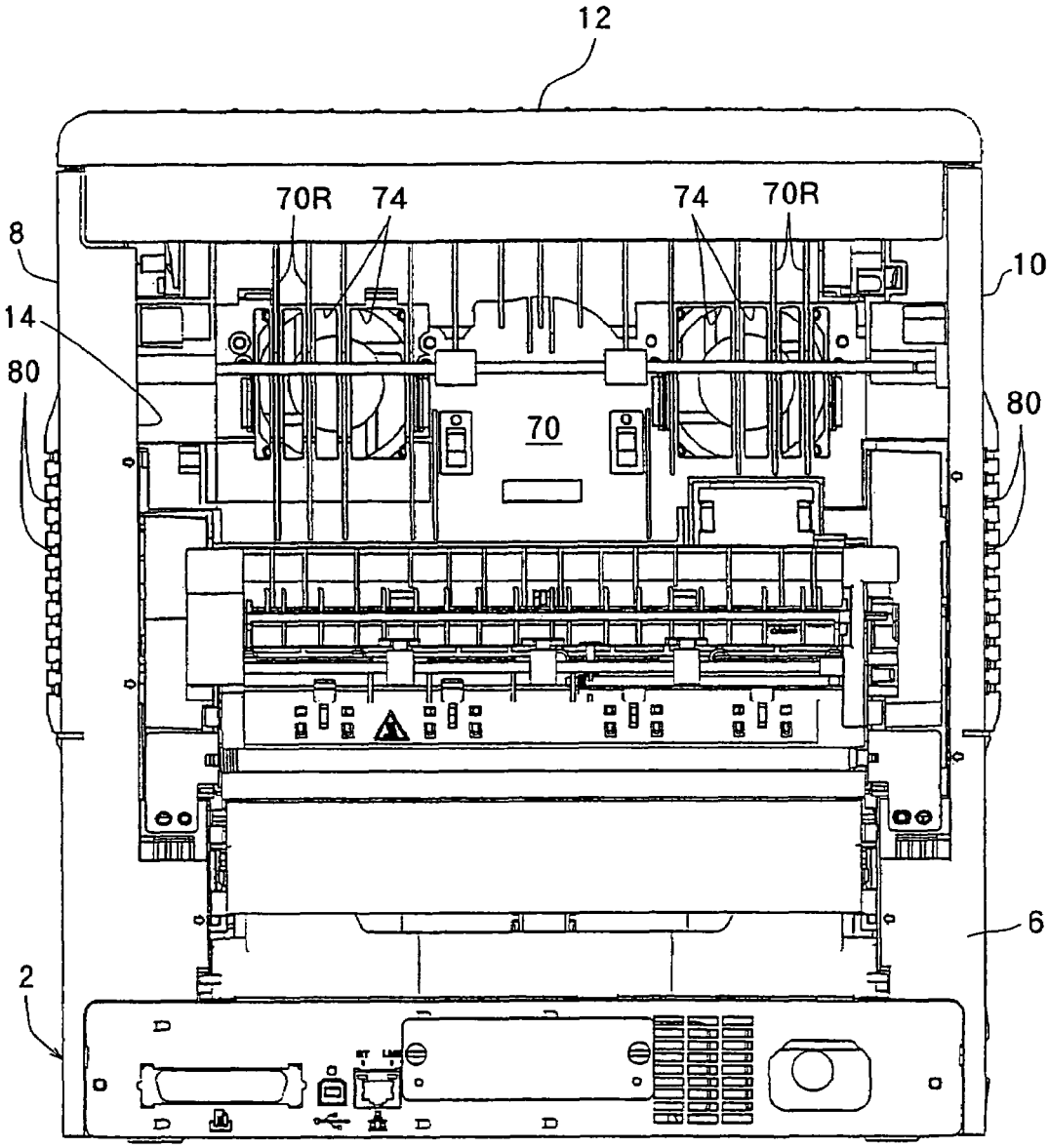
FIG. 3 is a rear view of the image-forming apparatus of FIG. 1 in a state where the rear cover is removed.

Another plurality of ventilating ports 82 are formed in an upper end of the right side wall 8 near the front side wall 4 which is another side wall facing the rear side wall 6 (see FIGS. 1 and 2). A cooling fan 84 (shown by a dotted line in FIG. 5) is arranged inside the ventilating ports 82 to suck the air into the interior of the apparatus body 2 from the exterior thereof through the ventilating ports 82.

In the above image-forming apparatus 100, the printing operation is carried out in a customary manner as described below briefly.

Referring to FIG. 4, to effect the printing, the surfaces of the photosensitive material drums 30 uniformly charged by the charger units 31 are exposed to light due to the LED heads 32 thereby forming electrostatic latent images in the process units 20, 22, 24 and 26. The electrostatic latent images are developed by the developing units 33 to form toner images. The toner images are transferred onto the intermediate transfer belt 44 of the intermediate transfer belt mechanism 36 by the primary transfer roller 34 so as to be successively superposed starting from the toner image formed by the process unit 20 of the upstream side. The color toner image transferred onto the intermediate transfer belt 44 is transferred onto a common paper P that is fed from the paper feed cassette 50 as it passes through the nipping portion between the driven roller 42 and the secondary transfer roller 46. The toner image transferred onto the common paper P is heat-fixed onto the common paper P as it passes through the fixing means 60. The common paper P onto which the toner image is heat-fixed is conveyed by a pair of conveyer rollers 62 and 66 to pass through the discharge conveying passage 64, and is discharged by a pair of discharge rollers 68 onto the discharged paper tray 12. In the process units 20, 22, 24 and 26, the toner remaining on the surface of the photosensitive material drum 30 without being transferred is cleaned by the cleaning unit 35. The toner remaining on the intermediate transfer belt 44 is cleaned by the cleaning unit 45 for the intermediate transfer belt 44 arranged at a position facing the driven roller 40 via the intermediate transfer belt 44.

Referring to FIGS. 4 and 5, as the cooling fans 72 are rotated in the above image-forming apparatus 100, there is produced a nearly horizontal air stream by the cooling fans 72 from the inside of the apparatus body 2 (from the right side in the axial directions of the cooling fans 72 in FIGS. 4 and 5) heading toward the discharge conveying passage 64 and the rear cover 16 (toward the left side in the axial directions of the cooling fans 72 in FIGS. 4 and 5). As a result, the air sucked into the interior of the apparatus body 2 from the exterior thereof passes through the vicinities of the process units 26, 24, 22 and 20, and is blown onto the discharge conveying passage 64 by the cooling fans 72 through the exhaust ports 74. Here, when the printing operation is not conducted, the air blown onto the discharge conveying passage 64 is exhausted out of the apparatus body 2 through the exhaust ports 76 in the rear cover 16. Arrows in FIGS. 4 and 5 indicate the flow of the air.

As described above, the air sucked into the apparatus body 2 is exhausted passing through the vicinities of the process units 26, 24, 22 and 20 out of the apparatus body 2 by means of the cooling fans 72. Namely, the air having been heated by the LED heads 32 provided for the process units 26, 24, 22 and 20 and similarly, having been heated by the electric motors for driving the photosensitive material drums 30 provided for the process units 26, 24, 22 and 20, inside the apparatus body 2, is forcibly exhausted without staying. As a result, the interior of the apparatus body 2 and, particularly, the vicinities of the process units 26, 24, 22 and 20 are effectively cooled, thereby preventing the toner in the developing apparatus 33 and the toner recovered by the cleaning device 35 from being solidified.

The air is sufficiently sucked into the interior of the apparatus body 2 from the exterior thereof by utilizing the gaps existing in the front side wall 4, right side wall 8 and left side wall 10. Therefore, there is no need of using a duct for sucking the air from the exterior of the apparatus body 2. Therefore, the constitution is simplified, the apparatus body is realized in a reduced weight, in a small size and at a decreased cost.

As described above, the air sucked into the apparatus body 20 from the exterior thereof by rotating the cooling fans 72 cools the process units 26, 24, 22 and 20 and simultaneously, is blown onto the common paper P which passes through the discharge conveying passage 64 and to which the toner image has been heat-fixed by the fixing means 60, when the printing operation is carried out in a state where the air is blown onto the discharge conveying passage 64 by the cooling fans 72. The common paper P to which the toner image has been heat-fixed is cooled fully reliably. When discharged onto the discharged paper tray 12, therefore, the common paper P is prevented from sticking to other common papers P, and besides, it does not happen that the common paper P is too hot to be picked up from the discharged paper tray 12. According to the present invention as described above, the interior of the apparatus body 2 and the common paper P to which the toner image has been heat-fixed can be simultaneously cooled down by the cooling fans 72; i.e., efficient and effective cooling is accomplished.

A common paper P to which a color image is fixed tends to be easily curled. In particular, the common paper P tends to be very easily curled when an image is fixed thereon with a printing ratio as high as close to four-color solid printing. According to the present invention, however, the common paper P is cooled by the cooling fans 72 immediately after the toner is heat-fixed thereto by the fixing means 60, thereby effectively preventing the occurrence of curling.

The process units 26, 24, 22 and 20 are arranged substantially in parallel in the axial direction of the cooling fans 72 in the apparatus body 2 or, in other words, are arranged in a direction in which the air stream produced by the cooling fans 72 flows (in nearly a horizontal direction in FIG. 4) making it possible to efficiently and easily exhaust the air heated at high temperatures near the process units 26, 24, 22 and 20.

The upper cover has a paper discharge portion or, in this embodiment, the discharged paper tray 12 that is tilted downward toward just the upper side of the cooling fans 72 from the front side to the rear side of the apparatus body 2. The top portion of the image-forming means 100A is arranged facing the lower surface of the discharged paper tray 12, just thereunder at a gap. As the cooling fans 72 are operated, the air that ascends in the apparatus body 2 being heated by the LED heads 32 and the like passes through a gap between the top portion of the image-forming means 100A and the lower surface of the discharged paper tray 12, and flows toward the cooling fans 72 along the lower surface of the discharged paper tray 12. This constitution makes it possible to collect the air that has ascended in the apparatus body 2 after having been heated, so as to be efficiently exhausted by the cooling fans 72 without requiring for any particular duct or any additional cost.

The fixing means 60 is so arranged as to extend in a horizontal direction at right angles with the axial directions of the cooling fans 72 under the cooling fans 72. Among the fixing means 60, cooling fans 72 and image-forming means 100A or, in this embodiment, process unit 20, there is provided a partitioning wall 78 for substantially partitioning the fixing means 60, cooling fans 72 and process unit 20, the partitioning wall 78 extending in a horizontal direction at right angles with the axial direction. The air that is produced by rotary-driving of the cooling fans 72 and flows from the side of the image-forming means 100A toward the discharge conveying passage 64 passes above the partitioning wall 78. Therefore, the air heated by the fixing means 60 is not sucked by the air that is blown onto the common paper P passing through the discharge conveying passage 64. As a result, the effect for cooling the common paper P is not lost. Besides, a rise in the temperature of the image-forming means 100A is not caused by the heat of the fixing means 60.

A tilted gap 79 is formed between the partitioning wall 78 and the image-forming means 100A or, in this embodiment, the process unit 20 so that the air is caused to flow upward to the cooling fans 72 from the lower side of the process unit 20. This constitution contributes to cooling the interior of the apparatus body 2 by effectively exhausting the air that is heated and ascends in the apparatus body 2.

The cooling fans 72 are arranged between the image-forming means 100A or, in this embodiment the process unit 20 and the discharge conveying passage 64, that is, are arranged on the inside of the discharge conveying passage 64. Therefore, the air blown onto the common paper P passing through the discharge conveying passage 64 is interrupted from flowing by the common paper P and is directed toward the right side wall 8 and the left side wall 10. When the partitioning wall 78 is provided, the air flows toward the right side wall 8 and the left side wall 10 along the upper surface of the partitioning wall 78. A plurality of ventilating ports 80 are respectively formed in the right side wall 8 and in the left side wall 10. Since the ventilating ports 80 are arranged in the regions spanning from the lower side to the upper side of the partitioning wall 78 on an extension thereof in the right side wall 8 and the left side wall 10, the air can be exhausted to the exterior through the ventilating ports 80. The air is exhausted to the exterior not only through the ventilating ports 80 but also through the gaps among the right side wall 8, left side wall 10 and rear side wall 6, and through the discharge opening through which the common paper P is discharged onto the discharged paper tray 12 after the image is fixed thereon. Therefore, the interior of the apparatus body 2 can be effectively cooled.

As described earlier, the cooling fan 61 for cooling the fixing means 60 is arranged on the inside of the ventilating ports 80 formed in the right side wall 8 and on an extension on the inner side area of the partitioning wall 78. During the printing operation, the cooling fan 61 is rotated and hence, the external air is sucked into the apparatus body 2 through the ventilating ports 80 of the left side wall 10. The air sucked into the apparatus body 2 flows through the vicinities of the fixing means 60 positioned on the inside of the partitioning wall 78, and is exhausted to the exterior by the cooling fan through the ventilating ports 80 in the right side wall 8. Therefore, the air that is interrupted by the common paper P from flowing as described above and is directed toward the right side wall 8 and the left side wall 10 on the outer side of the partitioning wall 78, is finally exhausted through the ventilating ports 80 separately from the air stream produced by the cooling fan 61 for cooling the fixing means 60 (due to the partitioning by the partitioning wall 78). Heat of the fixing means 60 is shut off by the partitioning wall 78 so will not to be directed toward the image-forming means 100A, and the temperature in the apparatus body 2 is prevented from rising.

As described earlier, another plurality of ventilating ports 82 are formed in an upper part of the right side wall 8 near the front side wall 4. A cooling fan 84 (FIG. 5) is arranged on the inside of the other ventilating ports 82 for sucking the air into the apparatus body 2 from the exterior thereof through the other ventilating ports 82. Though not illustrated, the process units 20, 22, 24 and 26 are supported at their both ends in the lengthwise direction (up-and-down direction in FIG. 5) by the right side plate and the left side plate arranged in the apparatus body 2. The right side plate and the left side plate are arranged on the insides of the right side wall 8 and the left side wall 10 at a gap. A substrate having electric parts is mounted on the outer side of the right side plate at a gap. On the substrate, there are mounted four electric motors for driving the rotary members such as the photosensitive material drums in the process units 20, 22, 24 and 26. A plurality of ventilating ports are formed in an upper part of the right side plate.

As the cooling fan 84 is rotated, the air sucked from the exterior of the apparatus body 2 through the other ventilating ports 82 is discharged to the exterior through the ventilating ports 80 in the right side wall 8 passing through a gap serving as the duct between the substrate and the right side plate. This air stream cools the electric motors. Further, part of the air sucked into between the right side plate and the substrate by the cooling fan 84 is blown toward the side of the image-forming means 100A through the plurality of ventilating ports formed in the right side plate. As this air is heated after having cooled the electric motors, an ascending air stream is produced near the process units 20, 22, 24 and 26. Being drawn by the ascending air stream, there are also produced ascending air streams in the vicinities of the process units 20, 22, 24 and 26, and these air streams are sucked by the cooling fans 72 and are exhausted to the exterior of the apparatus body 2 in a manner as described earlier.

Noise is generated to some extent as the cooling fans 61, 72 and 84 rotate. In the above image-forming apparatus 100, the cooling fans 72 are arranged inside the discharge conveying passage 64 on the inside of the rear side wall 6 remotest from the front side wall 4 to which the user faces and hence, this contributes to lower the degree which the user may feel offensive.

In the monochromatic image-forming apparatus, in general, there exists a considerable gap surrounding the image-forming means. Therefore, the LED heads need not be intentionally cooled but are cooled to a sufficient degree with the air stream produced in the apparatus body by the cooling fan for the fixing means. However, the illustrated tandem color image-forming apparatus has a size (i.e., is small in size) same as that of the monochromatic image-forming apparatus, and includes process units of four colors in the apparatus body leaving little gaps in the apparatus body. Therefore, the interior of the apparatus body is heated to a very high temperature unless heat generated by the LED heads is forcibly discharged out of the apparatus. In the color image-forming apparatus, in particular, many of the formed images are close to solid printing of photographs as compared to those of the monochromatic image-forming apparatus, and the LED elements are turned on for extended periods of time correspondingly. Therefore, the temperature of the LED heads tend to be heated higher than when they are used in the monochromatic image-forming apparatus. There are possibilities that LED heads tend to become faulty when their temperatures are raised and, further, cause colors to be deviated when they are warped by heat. Besides, heat generated by the electric motors for driving the photosensitive material drums is also transmitted to the photosensitive material drums and may cause troubles. The present invention eliminates these problems by employing a simple and inexpensive constitution.

The present invention can be applied to a tandem color image-forming apparatus as well as to color image-forming apparatuses of other forms and to monochromatic image-forming apparatuses. The color image-forming apparatuses of other forms may include a color image-forming apparatus of a form which uses, for example, color toners of three colors and a color image-forming apparatus of a form in which toners of different colors are successively overlapped on a recording medium that is conveyed so as to be transferred. The cooling fans 72 are arranged in a number of two in the above embodiment of the present invention. The number of the cooling fans, however, may be suitably determined depending upon various conditions such as the size of the image-forming apparatus. Besides, the numbers of the exhaust ports 74 and 76, and of the ventilating ports 80 may be suitably selected, as a matter of course.

What we claim is:

1. An image-forming apparatus comprising an image-forming means for forming a toner image and for transferring it onto a recording medium by an electrophotographic system, a fixing means for heat-fixing the toner image onto the recording medium, and a discharge conveying passage for conveying the recording medium onto which the toner image has been heat-fixed to a discharge portion, which are arranged in an apparatus body, the image-forming means comprising developing units, wherein at least one cooling fan for forming an air stream heading from at least the side of the developing units of the image-forming means toward the discharge conveying passage is arranged facing the discharge conveying passage, and exhaust ports are formed in the discharge conveying passage facing the cooling fan.

2. An image-forming apparatus according to claim 1, wherein the cooling fan is disposed at a distance relative to the image-forming means in a horizontal direction, and when the cooling fan is operated, the air sucked into the interior of the apparatus body from the exterior thereof is blown onto the discharge conveying passage passing through the periphery of the image-forming means.

3. An image-forming apparatus according to claim 2, wherein the image-forming means comprises a plurality of process units arranged in parallel nearly in the axial direction of the cooling fan, and when the cooling fan is operated, the air sucked into the interior of the apparatus body from the exterior thereof is blown onto the discharge conveying passage passing through the vicinities of the process units.

4. An image-forming apparatus according to claim 1, wherein the fixing means is so arranged as to extend in a horizontal direction at right angles with the axial direction of the cooling fan under the cooling fan, a partitioning wall is arranged between the fixing means and the cooling fan and between the fixing means and the image-forming means, and extends in a horizontal direction at right angles with the axial direction to substantially partition the fixing means, the cooling fan and the image-forming means from each other, and the air heading from the side of the image-forming means toward the discharge conveying passage passes through above the partitioning wall.

5. An image-forming apparatus according to claim 4, wherein a gap is formed in a tilted manner between the partitioning wall and the image-forming means so that the air flows upward from the lower side of the image-forming means toward the cooling fan.

6. An image-forming apparatus according to claim 4, wherein the apparatus body has two other side walls facing each other at a distance in a horizontal direction at right angles with the axial direction of the cooling fan, and ventilating ports are formed in one and/or both of said two other side walls, said ventilating ports being arranged in a region spanning from a lower side to an upper side of the partitioning wall on an extension of the partitioning wall in one andlor both of the two other side walls.

7. An image-forming apparatus according to claim 6, wherein the cooling fan for forming an air stream that flows to the exterior from the interior of the apparatus body passing through the ventilating ports to cool the fixing means is arranged on an extension of the inner region of the partitioning wall on the inside of the ventilating ports formed in one of the two other side walls.

8. An image-forming apparatus according to claim 7, wherein the other ventilating ports are formed in an upper end of one of the two other side walls and at a position near the other side wall facing said one side wall, and a cooling fan is arranged on the inside of said other ventilating ports to suck the air into the interior of the apparatus body from the exterior thereof through said other ventilating ports.

9. An image-forming apparatus according to claim 1, wherein the apparatus body comprises four side walls which are a front side wall located on the front side of the apparatus body, a rear side wall located on the rear side facing the front side wall at a distance, a right side wall located on the right side of the apparatus body, a left side wall located on the left side and facing the right side wall at a distance, and an upper cover covering the four side walls from the upper side.

10. An image-forming apparatus according to claim 9, wherein said upper cover has the paper discharge portion which is tilted downward toward just the upper side of the cooling fan from the front side to the rear side of the apparatus body, the top portion of the image-forming means is arranged facing the lower surface of the paper discharge portion, just there under at a gap and, when the cooling fan is operated, the air that ascends being heated in the apparatus body passes through the gap between the top portion of the image-forming means and the lower surface of the paper discharge portion and flows toward the cooling fan along the lower surface of the paper discharge portion.

11. An image-forming apparatus according to claim 1, wherein the image-forming means further comprises process units, each of the process units comprising one of the developing units and an LED head.

* * * * *